US005517890A

United States Patent [19]

Cooperman

[11] Patent Number: 5,517,890

[45] Date of Patent: May 21, 1996

[54] TUNABLE DRUM

[75] Inventor: Patrick H. Cooperman, Essex, Conn.

[73] Assignee: Cooperman Fife & Drum Co., Inc., Centerbrook, Conn.

[21] Appl. No.: 227,470

[22] Filed: Apr. 14, 1994

[51] Int. Cl.[6] ..... G10D 13/02

[52] U.S. Cl. ..... 84/411 R; 84/413

[58] Field of Search ..... 84/411 R, 412, 84/413, 418, 419, 420, 411 A

[56] References Cited

U.S. PATENT DOCUMENTS 5,375,500 12/1994 Halpin ..... 84/413

*Primary Examiner*—Cassandra C. Spyrou

*Attorney, Agent, or Firm*—Gretchen Platt Stubenvoll

[57] ABSTRACT

The invention is a tunable drum including a moveable bearing member positioned under the drum head and above the drum body, at least one alignment peg located between the bearing member and the drum body, and a mechanism engaging the moveable bearing member for moving the bearing member relative to the drum body so as to adjust the tension in the head.

9 Claims, 3 Drawing Sheets

PRIOR ART

PRIOR ART

TUNABLE DRUM

FIELD OF THE INVENTION

The present invention relates to apparatus used for tuning a drum or similar musical instrument.

BACKGROUND OF THE INVENTION

Musical instruments that include a body having an opening formed therein, and a membrane covering the opening and attached to the body, are commonly referred to as drums. Typically, rhythmic beats are created with the drum by striking the membrane with sticks, or similar devices, or with the hands. Rhythmic beats can also be created by striking the body of the drum. The tone or pitch of a drum is dependent on the tension imparted on the membrane. The greater the tension, the higher the pitch. The lower the tension, the lower the pitch.

A commonly known "stick" drum 10 is shown in FIG. 1. Examples of stick drums include snare drums, tom-toms and bass drums, all typically having two membranes or "drum heads" 16, as more fully described below. The body or "drum shell" 12 of drum 10 is usually generally circular in shape and varies in depth DP, diameter DM and thickness T, depending on the type of drum. The drum shell 12 is traditionally made from wood although it can also be made from synthetic materials.

The drum shell 12 includes at least one opening 14 formed therein which is covered by a membrane or drum head 16. Traditionally, the drum head 16 is made of animal skin, such as calf, goat or fish skin. The drum head 16 can also be made from synthetic materials, such as plastic.

The bearing edge 18 of the drum shell 12, usually the perimeter of the opening 14, is the edge of the drum shell 12 which touches the drum head 16. Oftentimes the bearing edge 18 is beveled so that only a small portion of the shell's thickness T touches the head 16.

As shown in FIG. 1, the head 16 of a stick drum 10 is secured to a generally circular first hoop 20, usually referred to as a "flesh hoop," which is typically made of wood or metal. The flesh hoop 20 and head 16 are positioned on the shell 12 so as to cover the opening 14 and rest on the bearing edge 18. A generally circular second hoop 22, usually referred to as a "counter hoop," is placed on top of the flesh hoop 20. The counter hoop 22 is typically made of metal.

Tension lugs 24 are attached to the counter hoop 22 and shell 12. A typical tension lug 24 includes a bolt 26 attached to the counter hoop 22 and threaded through a nut 28 attached to the shell 12. The head 16 is attached to the shell 12 by securing the flesh hoop 20 between the counter hoop 22 and bearing edge 18 via tension lugs 24. As the tension lugs 24 are tightened, the counter hoop 22 is forced toward the bearing edge 18, thus increasing the tension imparted onto the head 16. This increased tension stretches the head 16 to "tune" the head 16.

The head 16 can also be tuned by loosening the tension lugs 24 to release the force imparted on the counter hoop 22, thus allowing the counter hoop 22 to move away from the bearing edge 18 and reducing the tension in the head 16.

The tension lugs and counter hoop are commonly referred to as "hardware," the mechanisms used to tension and fasten the head to the drum shell 12. Oftentimes the hardware interferes with the playing of a stick drum, as it may prevent the sticks from making proper contact with the head 16.

Further, the hardware also detracts from the appearance of the drum.

A typical frame drum 100, as shown in FIG. 2, generally refers to any single headed drum having a diameter DM of the head 16 greater than the depth DP of the drum shell 12. Examples of frame drums include tambourines and Irish bodhrans. The head 16 is stretched over the opening 14 and fastened to the drum shell 12 with suitable attaching means, such as glue, staples or tacks 30. Oftentimes a decorative ribbon or tape 32 is placed over the raw edge of the drum head 16 prior to securing the head 16 to the shell 12 with the attaching means 30.

Traditionally, this type of drum does not include any tuning mechanisms. Instead, the drum head 16 is tuned when it is stretched over the opening 14 and attached to the drum shell 12. To change the musical tones of this type of drum, the head 16 must be removed from the shell 12 and either further stretched or loosened, and then reattached to the shell 12. This method of tuning a frame drum is cumbersome and oftentimes damages the head 16 and shell 12. Thus, the tuning mechanism previously described for stick drums has been incorporated into the frame drums, as shown in FIG. 3.

Other types of drums similar to frame drums are known as "body" drums. These drums are single headed drums having the depth DP of the drum shell greater than the diameter DM of the head. Examples of body drums include congas and African barrel drums. Similar to frame drums, body drums include a head stretched over the opening in the drum shell and attached to the shell by suitable attaching means. Typically, these drums are not readily tunable, although the tuning mechanism previously described for stick drums has been incorporated into body drums.

Musical tones are made with frame and body drums typically by beating the head with the hands. When a counter hoop 22 and tensions lugs 24 are incorporated into these drums to permit tuning, this hardware oftentimes interferes with the playing of the drums and detracts from the appearance of the drums. Further, the hardware adds noticeable weight to frame drums which is a disadvantage because these drums are normally held in one hand while they are played.

Therefore, it is desirable to provide frame and body drums with a tuning mechanism that does not interfere with the playing of the drums, add noticeable weight to the drum and detract from the appearance of the drums. Further, it is desirable to provide stick drums with a tuning mechanism which does not interfere with the playing of the drums, and detract from the appearance of the drum.

SUMMARY OF THE INVENTION

The present invention relates to apparatus for tuning a drum, or similar instrument, including a body having an opening therein and a drum head covering the opening and attached to the body by suitable attaching means. The tuning apparatus comprises a movable bearing member located between the body and head, and means for moving the bearing member relative to the body.

In a preferred embodiment, the body includes screw receiving means positioned at or near the opening of the body. The means for moving the bearing member include at least one tuning screw threaded into and through the screw receiving means. The bearing member comprises at least one contact plate for receiving the screw threaded through the screw receiving means. At least one alignment peg is disposed between the bearing member and body to maintain the bearing member and body in proper alignment with one another.

The drum head is tuned by adjusting the tension in the drum head via turning the tuning screws within the screw receiving means. When each tuning screw is tightened, it engages the corresponding contact plate of the bearing member and forces the bearing member into the drum head and away from the body, thus increasing the tension imparted to the drum head. Alternatively, the drum head can be tuned by decreasing the tension imparted to the drum head by loosening the tuning screws to reduce the force imparted to the bearing member and allowing the bearing member to move toward the body.

The present invention also relates to a method for manufacturing a tunable drum which includes a drum shell having an opening formed therein, an inside wall adjacent the opening and a bearing edge formed at the perimeter of the opening. A preferred method of manufacturing a tunable drum includes the steps of attaching a inner wall extension to the inside wall of the drum shell at or near the opening and bearing edge of the drum shell. The combination of the drum shell and inner wall extension are then cut to form a movable bearing member which includes an upper portion of the drum shell, the bearing edge and an upper portion of the inner wall extension. A base member is formed by a lower portion of the drum shell and a lower portion of the inner wall extension.

Tuning screw receiving holes are formed in the lower portion of the inner wall extension and tuning screws are threaded into each screw receiving hole. Contact plates are attached to the bearing member for receiving the tuning screws. At least one alignment peg is inserted into the bearing member and a corresponding alignment hole for receiving the alignment peg is formed in the base member. Without the tuning screws threaded through the screw receiving holes, the bearing member is positioned onto the base member so that each alignment peg engages each alignment hole of the base member. The bearing edge and opening of the drum shell are covered with the drum head which is then attached to the drum shell by suitable attaching means.

DETAILED DESCRIPTION

Figure 1:
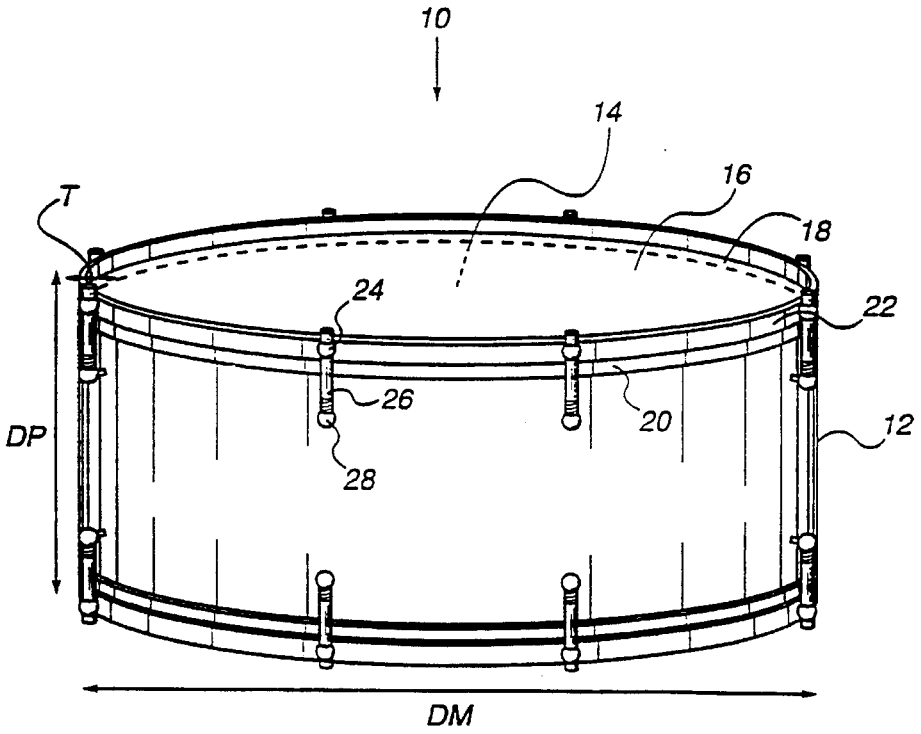
FIG. 1 PRIOR ART
FIG. 1 is a perspective view of a stick drum.
Figure 2:
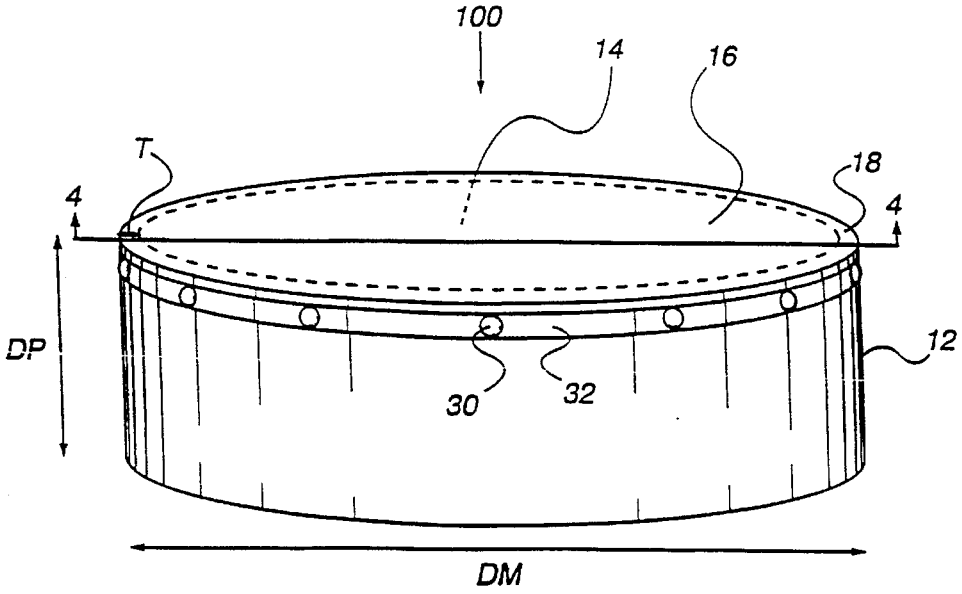
FIG. 2 is a perspective view of a frame drum.
Figure 3:
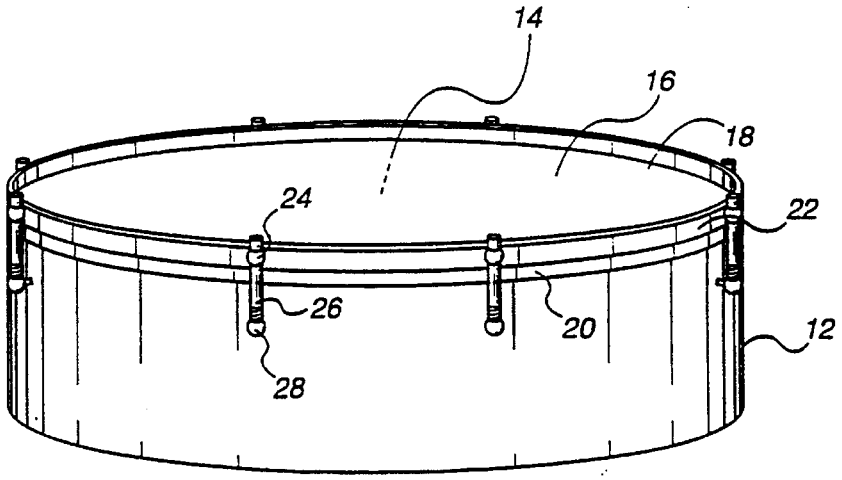
FIG. 3 is a perspective view of a frame drum comprising prior art tuning apparatus.
Figure 4:
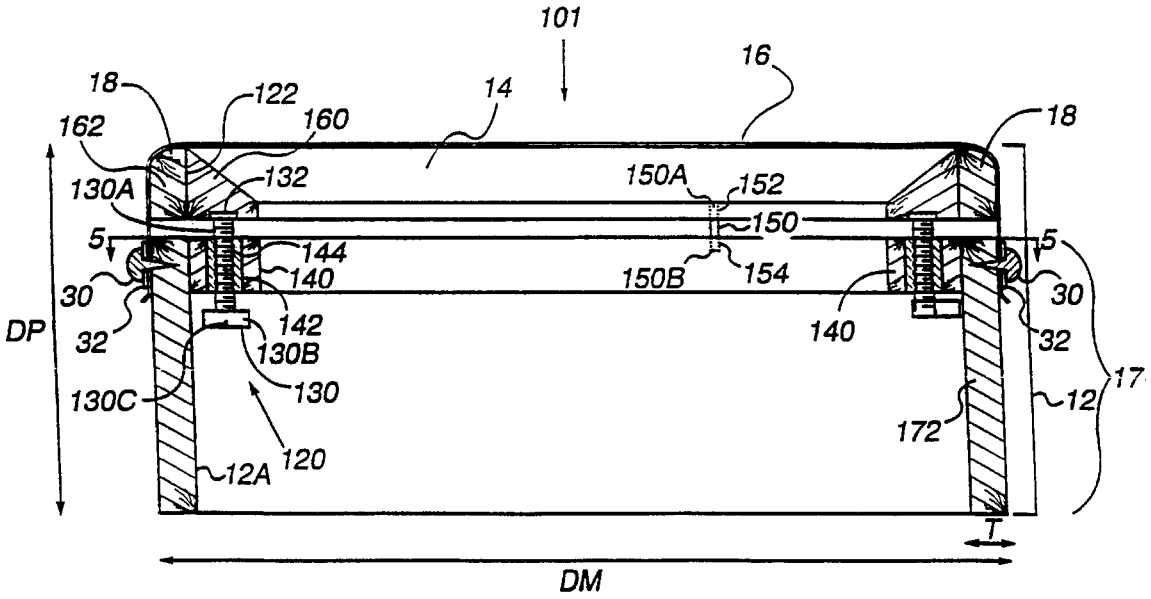
FIG. 4 is a cross-sectional view of the frame drum of FIG. 2 taken along line 4—4.

A cross-sectional view of a preferred embodiment of the tunable drum 101 or similar musical instrument is shown in FIG. 4. The tunable drum 101 includes a generally circular drum shell 12 having a depth DP, diameter DM and thickness T. The drum shell 12 includes at least one opening 14 formed therein which is covered by a drum head 16. The drum head 16 is attached to the drum shell by any suitable attachment means, such as glue, staples or tacks 30. Decorative ribbon or tape 32 may also be provided to cover the raw edge of the drum head 16. The tunable drum 101 further comprises a bearing edge 18 usually located at the perimeter of the opening 14 which is the edge of the drum shell 12 that touches the head 16. In a preferred embodiment, the bearing edge 18 is beveled, as shown in FIG. 4, so that only a small portion of the shell's thickness T touches the head 16.

The tunable drum 101 of the invention further comprises a tuning apparatus 120 including a movable bearing member 122 disposed between the head 16 and a base member 170 of shell 12, and means, such as a tuning screw 130, for moving the bearing member 122 relative to the shell 12. A tuning screw receiving means 140 is positioned at or near the opening 14 of the drum shell 12 into which the tuning screws 130 are threaded. It is understood that other means, such as a ratchet mechanism, pressure applying apparatus, or the like, may be used to move the bearing member.

Figure 5:
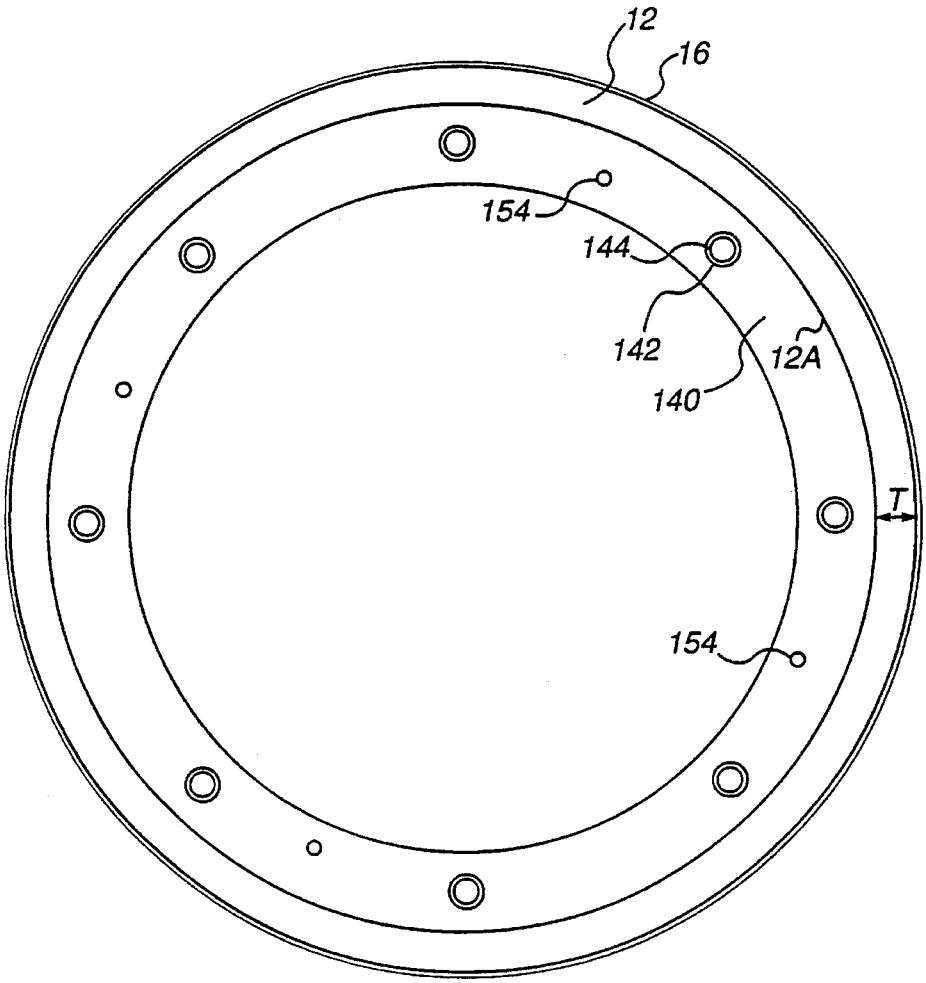
FIG. 5 is a cross-sectional view of the frame drum of FIG. 4 taken along line 5—5.

In a preferred embodiment, the tuning screw receiving means 140 is a generally circular member or shelf extending from an inner wall 12A of shell 12, as shown in FIGS. 4 and 5. The shelf 140 includes a plurality of holes 142 formed therein which receive a screw casing 144. A tuning screw 130 is threaded into and through each casing 144.

As shown in FIG. 4, the bearing member 122 of a preferred embodiment further includes at least one contact plate 132 positioned on the bearing member 122 opposite the head 16 to provide a surface for receiving a first end 130A of the tuning screw 130 when the tuning screw 130 is threaded into and through the screw receiving means 140. The contact plate 132 may be made of metal or other appropriate material to prevent the first end 130A end of the screw 130 from damaging the bearing member 122 when the screw 130 is turned. In a preferred embodiment, the number of contact plates 132 corresponds to the number of tuning screws 130 used in the tuning apparatus 120. Alternatively, the contact plate 132 may be a circular member (not shown) positioned on the bearing member opposite the head 16.

The tunable drum 101 of the invention further includes at least one alignment peg 150 positioned between the bearing member 122 and the base member 170 of the drum shell 12 for preventing the bearing member 122 from moving in a circular direction with respect to the base member 170 of the drum shell 12. In particular, as shown in FIGS. 4 and 5, a first end 150A of the alignment peg 150 is inserted into the bearing member 122 at hole 152 in the side of the bearing member opposite the head 16. A corresponding hole 154 for receiving a second end 150B of the alignment peg 150 is formed in the screw receiving means 140.

The tunable drum 101 of the invention is "tuned" by tightening or loosening the tuning screws 130. When the tuning screws 130 are tightened, the first end 130A of each screw 130 engages its corresponding contact plate 132 and forces the bearing member 122 away from the base member 170 of the shell 12 and toward the head 16, thus imparting an increased tension to the head 16 and raising the pitch of the drum 101. When the tuning screw 130 is loosened, the force imparted to the bearing member 122 via the first end 130A of each screw 130 is reduced, thus, decreasing the tension in the head 16 and lowering the pitch of the tunable drum 101.

As shown in FIG. 4, the second end 130B of the tuning screw 130 is provided with a slot 130C for receiving a screw driver (not shown) to turn the tuning screw 130. Alternatively, the second end 130B of the tuning screw 130 may include other means, such as a lug nut or hexagonal socket (not shown), suitable for turning the tuning screw 130.

Figure 6:
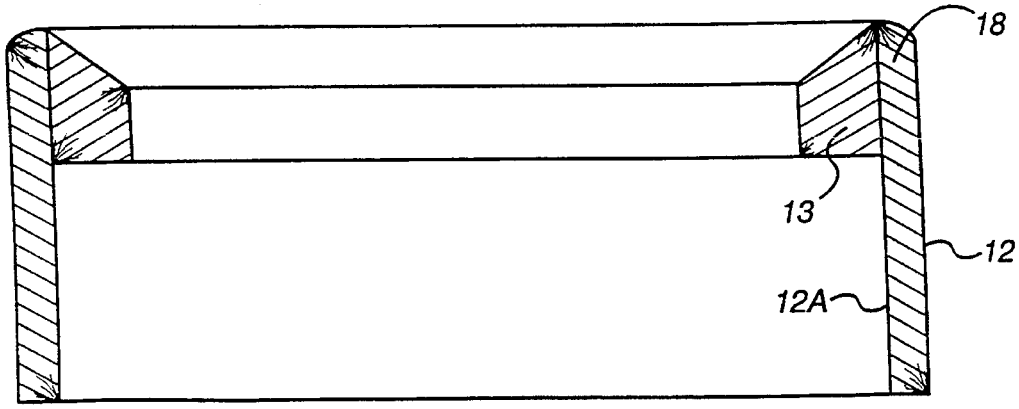
FIG. 6 is a cross-sectional view of the frame drum of FIG. 4 during manufacture.

The tunable drum 101 of the invention may be manufactured by attaching an inner wall extension 13 to the inside wall 12A of the shell at or near the opening 14 and bearing edge 18 of the shell, as shown in FIG. 6. The combination of the shell 12 and inner wall extension 13 are cut to form the movable bearing member 122 and base member 170. The movable bearing member 122 includes an upper portion 162 of the shell 12, the bearing edge 18 and an upper portion 160 of the inner wall extension 13. The base member 170 includes a lower portion 172 of the shell 12 and a lower portion of the inner wall extension, otherwise referred to as the screw receiving means 140. At least one tuning screw receiving hole 142 is formed in the screw receiving means 140 in which a casing 144 is then inserted.

At least on contact plate 132 is then positioned on the bearing member 122 for receiving the first end 130A of each tuning screw 130. At least one alignment hole 154 is formed in the screw receiving means 140 for receiving the second end 150B of an alignment peg 150 inserted into and extending from the bearing member 122. A tuning screw 130 is threaded into each casing 144 of the screw receiving means 140 so that the first end 130A of each screw 130 does not extend through the casing 144. The bearing member 122 is then rested on the base member 170 so that each alignment peg 150 extending from the bearing member 122 is aligned with and inserted into its corresponding alignment hole 154 in the screw receiving means 140.

The head 16 is then placed over the opening 14 and bearing edge 18, and then secured to the outside of the base member 170 of the shell 12 by suitable securing means 30. Prior to attaching the head 16 to the base member 170, a decorative ribbon or tape 32 may be attached to the raw edge of the head 16. Alternatively, the decorative ribbon or tape may be applied to the drum 101 after the head 16 has been attached to the base member 170, thus covering the attaching means 30.

The resulting drum can now be tuned with apparatus 120 that does not interfere with the playing of the drum, as the apparatus 120 is located inside the shell 12 and under the head 16. The tuning apparatus 120 also does not detract from the appearance of the drum. Further, in a preferred embodiment, the tuning apparatus 120 includes limited metal hardware, thus adding little weight to the drum 101. The tuning apparatus 120 can also be incorporated in double headed drums, such as stick drums, by providing access to the tuning apparatus 120 through an opening in the drum shell 12. Thus, double headed drums can be tuned by an apparatus that does not interfere with the playing of the drum or detract from the appearance of the drum.

Although the tunable drum invention and method of manufacture have been described in detail for the purpose of illustration, it is to be understood that such detail is solely for that purpose and that variations can be made therein by those skilled in the art without departing from the spirit and scope of the invention except as it may be limited by the claims.

What is claimed is:

1. Apparatus for tuning a musical instrument including a body having an opening formed therein and a membrane covering the opening and attached to the body, the tuning apparatus comprising:

a moveable bearing member disposed under the membrane and above the body;

at least one alignment peg disposed between the bearing member and the body; and means for moving the bearing member relative to the body.

2. The tuning apparatus of claim 1 wherein the body includes screw receiving means proximate the opening of the body, and the means for moving the bearing member include at least one tuning screw threaded into and through the screw receiving means and capable of contacting the bearing member.

3. The tuning apparatus of claim 2 wherein the bearing member comprises at least one contact plate for receiving the tuning screw threaded through the screw receiving means.

4. A tunable drum comprising:

a body having an opening formed therein;

a membrane covering the opening and attached to the body;

a moveable bearing member disposed under the membrane and above the body;

at least one alignment peg disposed between the bearing member and the body; and means for moving the bearing member relative to the body.

5. The tunable drum of claim 4 wherein the body includes screw receiving means proximate the opening of the body, and the means for moving the bearing member include at least one tuning screw threaded into and through the screw receiving means and capable of contacting the bearing member.

6. The tunable drum of claim 5 wherein the bearing member comprises at least one contact plate for receiving the tuning screw threaded through the screw receiving means.

7. A method for manufacturing a tunable drum including a body having an opening formed therein, an inner wall adjacent to the opening and a bearing edge formed at the perimeter of the opening, the method comprising the steps of:

attaching an inner wall extension to the inside wall of the body proximate the opening and bearing edge of the body;

cutting the combination of the body and inner wall extension to form a movable bearing member including an upper portion of the body, the bearing edge and an upper portion of the inner wall extension, and a base member including a lower portion of the body and a lower portion of the inner wall extension;

forming at least one screw receiving hole in the lower portion of the inner wall extension;

positioning the bearing member onto the base member;

covering the bearing edge and opening of the body with the membrane;

attaching the membrane to the base member of the body with suitable attaching means; and threading a tuning screw into the screw receiving hole.

8. The method of claim 7 further comprising the step of:

prior to positioning the bearing member onto the base member, attaching at least one contact plate to the upper portion of the inner wall extension of the bearing member for receiving the tuning screw threaded into and through the receiving hole.

9. The method of claim 7 further comprising the steps of:

inserting at least one alignment peg into the bearing member;

forming at least one alignment hole in the base member for receiving each alignment peg; and when positioning the bearing member onto the base member, aligning the alignment peg with the alignment hole of the base member.

* * * * *